US008887801B2

(12) United States Patent
Angelle et al.

(10) Patent No.: US 8,887,801 B2
(45) Date of Patent: Nov. 18, 2014

(54) STABILIZER FOR PIPE HANDLING EQUIPMENT

(75) Inventors: Jeremy R. Angelle, Lafayette, LA (US); Donald E. Mosing, Lafayette, LA (US); Oren M. Bowden, Broussard, LA (US)

(73) Assignee: Frank's International, LLC, Houston, TX (US)

( * ) Notice: Subject to any disclaimer, the term of this patent is extended or adjusted under 35 U.S.C. 154(b) by 321 days.

(21) Appl. No.: 12/798,999

(22) Filed: Apr. 14, 2010

(65) Prior Publication Data

US 2010/0200246 A1 Aug. 12, 2010

Related U.S. Application Data

(63) Continuation of application No. 11/975,858, filed on Oct. 22, 2007, now Pat. No. 7,726,394.

(51) Int. Cl.
*E21B 19/06* (2006.01)
*E21B 19/24* (2006.01)

(52) U.S. Cl.
CPC ..... *E21B 19/06* (2013.01); *E21B 19/24* (2013.01)
USPC ..... 166/77.52; 166/379; 166/77.51; 166/85.5

(58) Field of Classification Search
USPC ..... 166/379, 380, 77.51, 77.52, 85.5; 294/102.2, 82.12
See application file for complete search history.

(56) References Cited

U.S. PATENT DOCUMENTS

| | | | | |
|---|---|---|---|---|
| 4,354,706 | A * | 10/1982 | Coyle, Sr. | 294/102.2 |
| 7,726,394 | B2 * | 6/2010 | Angelle et al. | 166/77.52 |
| 2006/0113087 | A1 * | 6/2006 | Springett et al. | 166/380 |
| 2006/0191690 | A1 * | 8/2006 | Severin et al. | 166/379 |
| 2009/0056930 | A1 * | 3/2009 | Angelle et al. | 166/77.51 |

* cited by examiner

*Primary Examiner* — Jennifer H Gay
*Assistant Examiner* — Elizabeth Gitlin

(57) ABSTRACT

A stabilizer to suppress unwanted pivotal movement in pipe handling equipment suspended from bails. The stabilizer can contain either or both adjustable contacting members and non-adjustable contacting members which are rigidly connected to a portion of the pipe handling equipment. The adjustable contacting members contact the bails on one or both sides of the bail(s) to suppress motion of the elevator relative to the bail.

21 Claims, 8 Drawing Sheets

STABILIZER FOR PIPE HANDLING EQUIPMENT

CROSS REFERENCE TO RELATED APPLICATION

The present application is a continuation application that claims priority to the U.S. patent application Ser. No. 11/975,858, filed Oct. 22, 2007, now U.S. Pat. No. 7,726,394, the entirety of which is incorporated herein by reference.

TECHNICAL FIELD

This invention pertains to an apparatus and method for handling pipe, and more particularly, to an improvement in stabilizing various pipe handling equipment with respect to the bail(s) from which the equipment is suspended. This is accomplished with a stabilizing mechanism mounted to the pipe handling equipment, such as an elevator, which can suppress swinging and/or pivoting of the pipe handling equipment relative to the bail(s).

DETAILED DESCRIPTION OF EMBODIMENTS OF THE INVENTION

For a further understanding of the nature and objects of the invention, reference should be made to the following detailed description, taken in conjunction with the accompanying drawings.

A drilling rig operates to rotate a drill bit as the drill bit creates a borehole. The drill bit is connected to the drilling rig by sections of drill pipe, sometimes referred to as a pipe string. The drill pipe also provides drilling fluid to the drill bit.

As the borehole is drilled deeper, additional pipe sections must be added to the pipe string. Pipe handling equipment, e.g., elevators, can hoist pipe sections off of pipe racks into the air so they can be coupled together to form the pipe string. Elevators can also be used to temporarily suspend entire pipe strings in the borehole. Elevators can also be used to manipulate casing and casing strings, in addition to drill pipe strings.

Figure 1B:
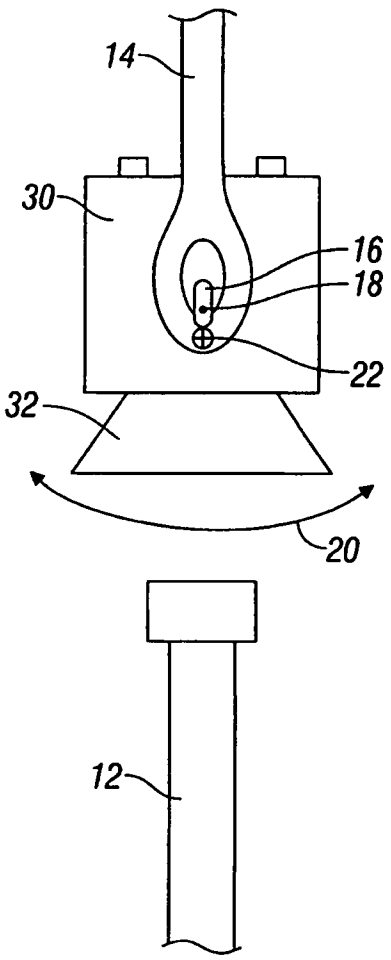
FIG. 1B (Prior Art)
FIG. 1B illustrates an elevator prone to tipping.
Figure 1A:
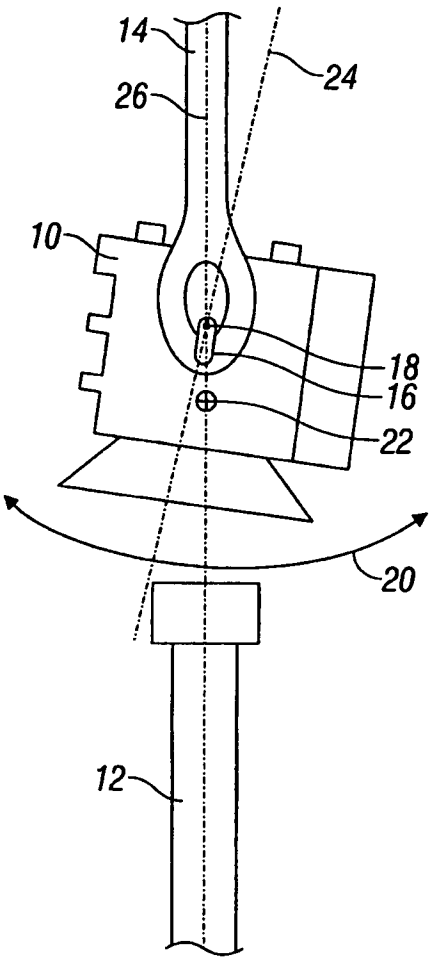
FIG. 1A (Prior Art)
FIG. 1A illustrates an unbalanced elevator.

FIG. 1A illustrates an unbalanced elevator 10 for stabbing a pipe string 12 disposed within a borehole (not pictured). Bails 14 (one bail is shown in FIG. 1A; a similar bail is located on the opposite side of the unbalanced elevator 10) typically suspend elevators during their operation. The unbalanced elevator 10 includes ears 16 (one ear is shown in FIG. 1A; a similar ear is located on the opposite side of the unbalanced elevator 10) for catching the loops of the bails. A pivot point is created at the point on each ear where the ear contacts the bail loop, resulting in a pivot axis 18 (see FIG. 4A) about which the unbalanced elevator 10 freely pivots relative to the bail. Arrow 20 in FIG. 1A illustrates the direction of this pivot motion. The unbalancing of the elevator is created when the center of gravity 22 of the elevator is misaligned with the pivot point of the elevator ear and bail loop contact, or when there is a misalignment between the elevator axis 24 and the center axis 26 of the drill pipe 12.

Elevator stabilizers as described herein provide particular advantages for unbalanced elevators. The unbalanced elevator 10 freely tips about this axis 18, and in its resting position, the centerline 24 becomes misaligned with the axis 26 of the pipe string. Tilted misaligned elevators can cause difficulty grabbing pipe strings 12 because the unbalanced elevator 10 may be tilted and will not readily slip over the top of the pipe string 12. The stabilizing systems and methods (i.e., stabilizers) of the invention can prevent this misalignment caused by unbalanced elevators, e.g., the stabilizing system and method can prevent the elevator from tilting relative to the bails.

The elevator stabilizers provide advantages when the weight of an elevator 30 is distributed such that the elevator's center of gravity 22 is close to the pivot axis 18 as illustrated in FIG. 1B. For example, as the unstable elevator 30 is lowered toward the pipe string 12, occasionally a lower guide 32 at the bottom of the elevator 30 contacts the pipe string 12 causing the elevator 30 to tip or pivot at the pivot axis 18 as indicated by path 20. The systems and methods of the invention stabilizes pipe-handling equipment relative to the bails, and therefore relative to the axis of the pipe string by preventing the pipe-handling equipment from pivoting about an essentially horizontal axis passing through the contact points of the elevator ears and bails. Therefore, the elevator is always maintained in a vertical orientation relative to the bails, and therefore relative to the pipe string with its central axis parallel to the axes of the bails prevents tipping caused in such unstable elevators because the stabilizers prevent the elevator from tilting relative to the center axis of the pipe string.

Figure 2A:
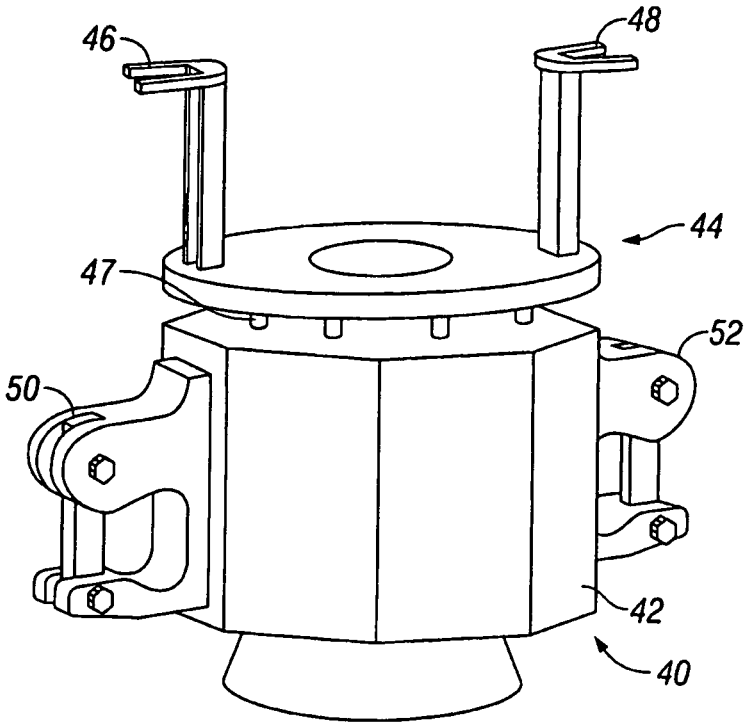
FIG. 2A (Prior Art)
FIG. 2A illustrates a slip type elevator with brackets mounted on the timing ring.
Figure 2B:
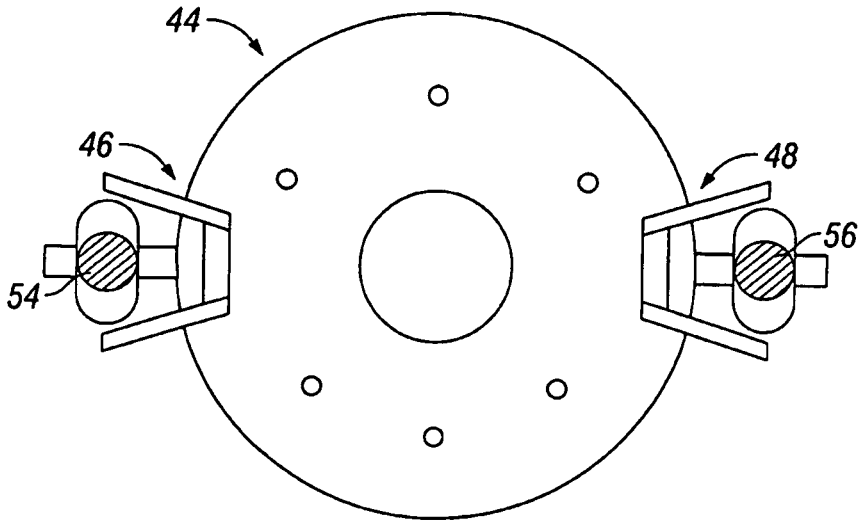
FIG. 2B (Prior Art)
FIG. 2B is a top view of brackets mounted to an elevator timing ring, showing the bails in section.

FIGS. 2A and 2B illustrate an elevator 40 comprising a body 42 and a timing ring 44 with a first bracket 46 and a second bracket 48 attached to the elevator timing ring. The timing ring 44 simultaneously actuates a number of slips (not shown) in a slip-type elevator 40 to engage/disengage a pipe section 12 (not shown). A set of pneumatically or hydraulically actuated pistons 47 operate to raise/lower the timing ring 44 vertically relative to the elevator body 42. The timing ring 44 actuates the slips into different positions depending on the location of the ring 44 relative to the body 42. In this way the timing ring 44 causes the slips to grip onto/release a pipe section within the elevator. Ears 50 and 52 attached to the elevator body 42 receive bail loops therein to suspend the elevator 40.

FIG. 2B illustrates the first bracket 46 and second bracket 48. These brackets serve as limits to potential pivotal movement of the elevator. A first bail 54 and a second bail 56 are shown in cross section in relation to the elevator 40. These brackets are rigidly connected to the timing ring 44, which moves up and down relative to the elevator body, and therefore relative to the bails. In this configuration, contact between the bails and the brackets results in scraping and may damage the pistons by cocking the timing ring relative to the elevator body. Preventing this contact requires significant clearance between the bails and the brackets because bails produced to handle differing loads or produced by different manufactures come in a variety of diameters. Additionally, irregularities on the surfaces of the bails extend the clearance required and increase the potential for damage should the brackets contact the bail while moving.

Figure 3:
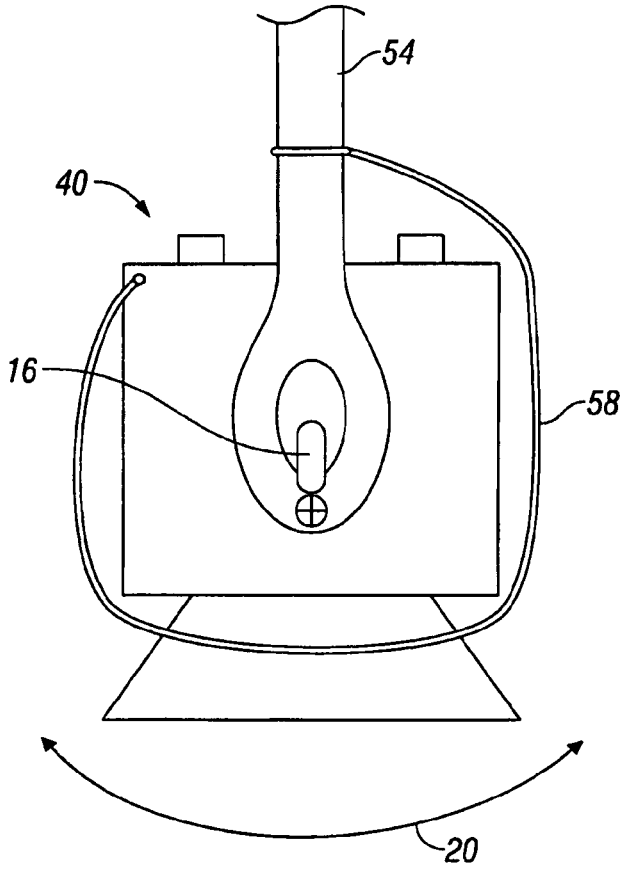
FIG. 3 (Prior Art)
FIG. 3 illustrates a prior art method of stabilizing an elevator with chains.

FIG. 3 illustrates an elevator stabilizing system previously known in the art with the elevator 40 suspended from a first bail 54 at the attached ear 16. Elevator 40 pivots relative to the bail 54 in the direction indicated by arrow 20. A chain 58 is wrapped around the first bail 54 to limit the elevator's pivoting motion as indicated by arrow 20. In one such prior art device, the chain 58 is attached to the elevator 40, then wrapped around and below the elevator and attached to the bail 54. The tension in chain 58 reduces the pivoting of the elevator 40.

Figure 4A:
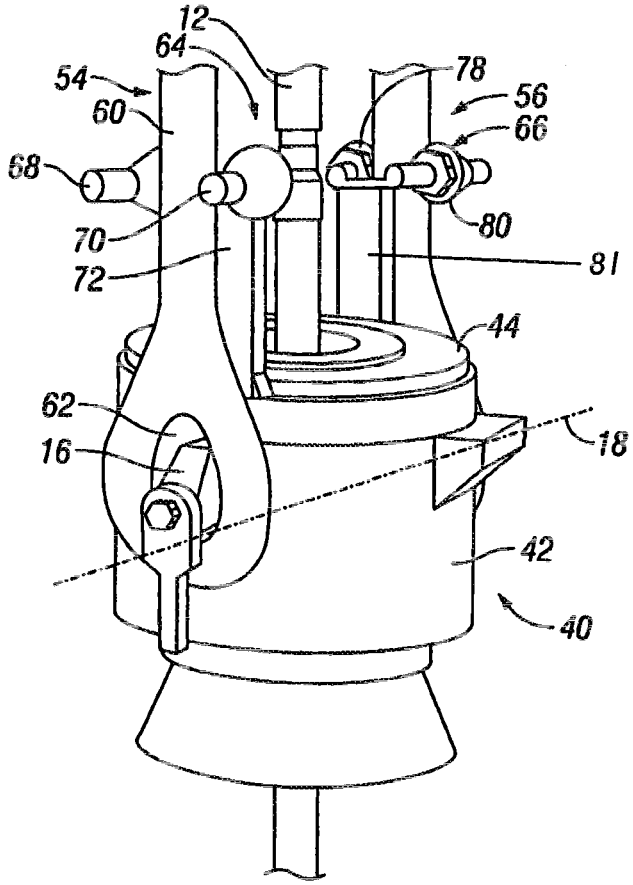
FIG. 4A is an isometric view of an elevator and stabilizer mechanism in accordance one embodiment of the invention.

FIG. 4A illustrates an elevator 40, which may be balanced or unbalanced as well as prone to tipping or not prone to tipping, employing an adjustable stabilizing mechanism of the invention. The adjustability of this embodiment allows for the stabilizing mechanism to be used on a variety of elevator designs and bail designs. The same adjustable stabilizing mechanism accommodates different sized bails as well as different bail configurations.

The elevator 40 includes a first ear 16 and a second ear (not shown) located on the opposite side of the elevator 40. A first bail 54 comprises a shaft 60 and a loop defining a slot 62 therein for receiving the elevator ear 16. A second bail 56 receives the ear on the opposite side of the elevator 40 in the same way, suspending the elevator from the first bail 54 and the second bail 56, creating a pivot axis 18 which allows the elevator 40 to otherwise pivot relative to the bails, and therefore relative to the pipe string. Pipe string 12 is shown passing through the top flange of a timing ring 44 and through the elevator 40.

In this embodiment, a first stabilizer system 64 adjustably contacts the first bail 54 and a second stabilizer 66 adjustably contacts the second bail 56 to reduce pivotal movement of the elevator 40 about the pivot axis 18. The first stabilizer system 64 comprises a first stabilizing mechanism 68 and a second stabilizing mechanism 70 attached at the end of a rigid member (e.g., first upright 72). Rigid member can be bolted, welded, or otherwise attached (e.g., rigidly attached) to the body of the elevator 40 or to the timing ring 44. The top surface of the depicted timing ring 44 is approximately the same size and configuration as top surface of the elevator body 42. Therefore, in order to attach the first upright 72 to the elevator 40, the timing ring 44 is formed with a cut out 74 to accommodate the first upright 72. This is best shown in FIG. 4B.

Figure 7A:
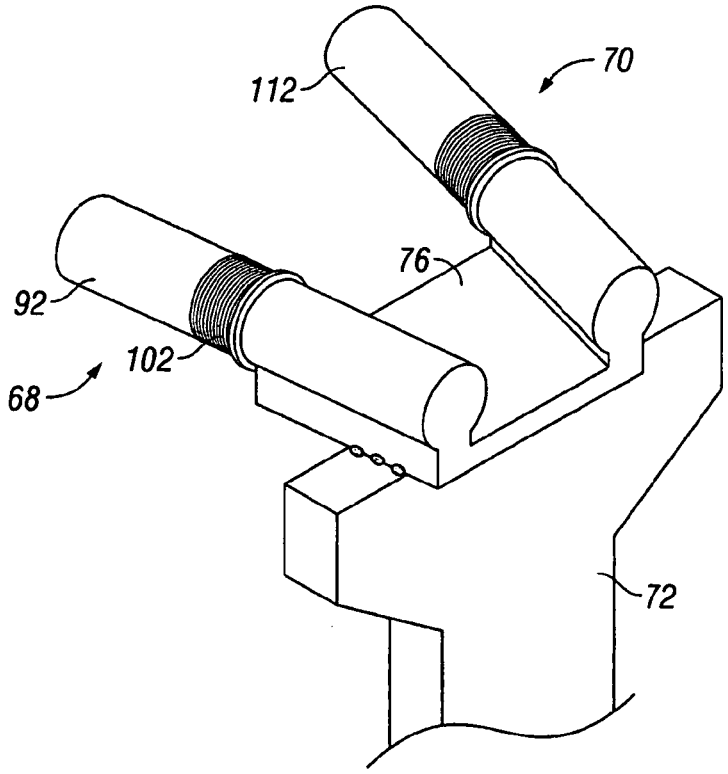
FIG. 7A is an isometric view of a stabilizer mechanism mounted to an upright in accordance with one embodiment of the invention.

Briefly referring to FIG. 7A, the first stabilizing mechanism 68 and second stabilizing mechanism 70 attach to a seat 76, which is attached to the upright 72. Returning to FIG. 4A, the spacing between the first stabilizing mechanism 68 and the second stabilizing mechanism 70 accommodates the first bail 54. Adjusting the first stabilizing mechanism 68 and the second stabilizing mechanism 70 urges the adjustable contacting members into abutment with the bails to firmly grip the bails between them, preventing the elevator 40 from swinging or pivoting with respect to the bail in either direction. This is best shown in FIG. 4B.

FIG. 4A illustrates the elevator 40 suspended from the bail and secured by the stabilizer mechanism. The first stabilizer 64 includes the first upright 72, the first stabilizing mechanism 68 and the second stabilizing mechanism 70. A second stabilizer 66 secures the second bail 56. The second stabilizer 66 includes a third stabilizing mechanism 78 and a fourth stabilizing mechanism 80 mounted to a second upright 81.

Figure 4B:
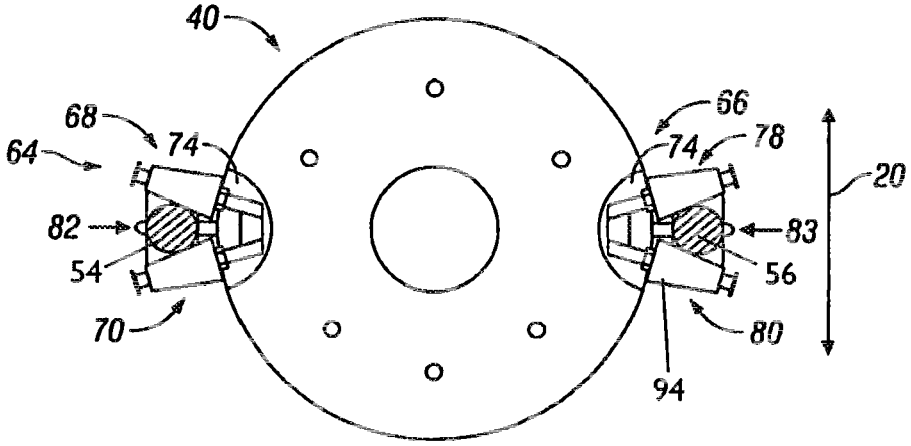
FIG. 4B is a top view of the embodiment of FIG. 4A, showing the bails in cross section.

FIG. 4B is a top view of the embodiment of the invention illustrated in FIG. 4A. FIG. 4B illustrates the adjustable contacting member 94 of the first stabilizing mechanism 68 and the adjustable contacting member 94 of the second stabilizing mechanism 70 of the first stabilizer 64 adjusted into contact with first bail 54. The adjustable contacting member 94 of the third stabilizing mechanism 78 and the adjustable contacting member 94 of the fourth stabilizing mechanism 80 on the second stabilizer 66 secure the second bail 56. Each stabilizing mechanism serves to suppress the pivoting motion of the elevator 40 relative to the bails.

In FIG. 4B, arrow 20 indicates the path along which the elevator 40 (which is rigidly attached to first upright 72) would otherwise pivot relative to first bail 54. FIG. 4B illustrates the first stabilizing mechanism 68 suppressing the motion of the elevator because there is no clearance for movement in one direction along path 20, and the second stabilizing mechanism 70 suppresses any clearance for the elevator 40 to move the other direction along path 20. It can be seen in FIG. 4B, there is no clearance for the first bail 54 to move toward the first stabilizer 64 because the first bail 54 rests against the first adjustable member 94 of the first stabilizing mechanism 68 and an adjustable member of the second stabilizing mechanism 70. In this manner, motion in the direction labeled 82 is suppressed. This motion in directions 82 and 83, perpendicular to motion 20, is suppressed because bails are located on opposite sides of the elevator. In the embodiment disclosed in FIG. 4A and FIG. 4B, each stabilizing mechanism is adjustable so they may be adjusted into abutment with the bails. One illustrative example of the adjustable means will be described in greater detail below.

While the embodiment illustrated in FIGS. 4A and 4B shows a stabilizer on each bail with a total of four stabilizing mechanisms, an alternative embodiment contemplates three, two or even a single stabilizing mechanism. For example, in the case of an unbalanced elevator that naturally tends to misalignment in a single direction, the weight distribution of the elevator biases the elevator body to rotate in the same direction relative to the bails. In order to prevent this misalignment, one stabilizing mechanism can be placed on the "light side" of the elevator at one bail. In this way, a single stabilizing mechanism can be used to prevent the elevator body from rotating in one direction and the forces tending to misalign the elevator body will act against rotation in the other direction.

Figure 5A:
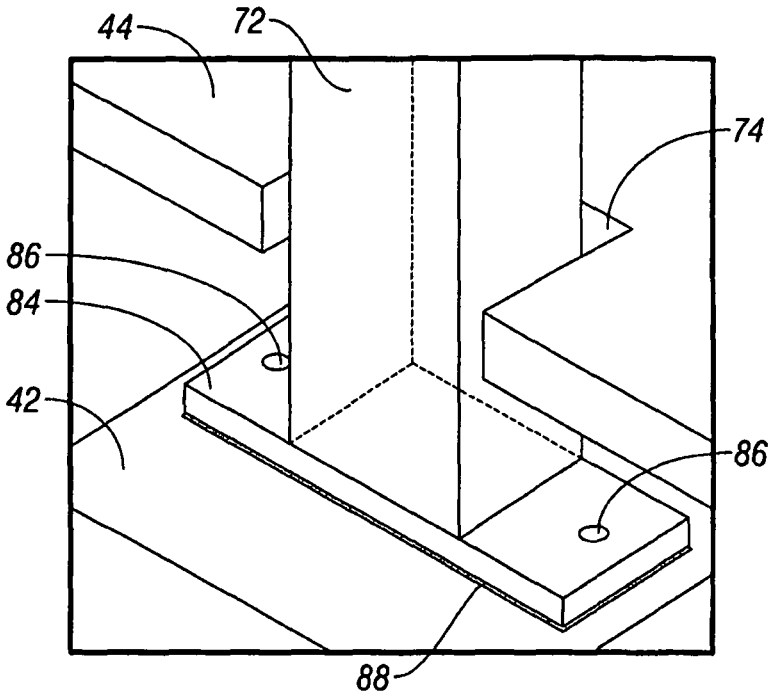
FIG. 5A is an isometric view of an upright mounted to an elevator in accordance with a different embodiment of the invention.

FIG. 5A illustrates the bottom of the first upright 72 attached to the top of the elevator body 42. The top flange of the timing ring 44 is shown, as well as the cut out 74 through which the first upright 72 passes. A flat piece 84 attaches the first upright 72 to the body of the elevator 42. The flat piece 84 contains holes 86 for receiving bolts (not shown) and connects to the first upright 72. Bolts are mated through holes 86 and into corresponding holes in the body of the elevator 42. The first upright 72 may also be welded at 88 to the elevator body 42, or bolted or both.

Figure 5B:
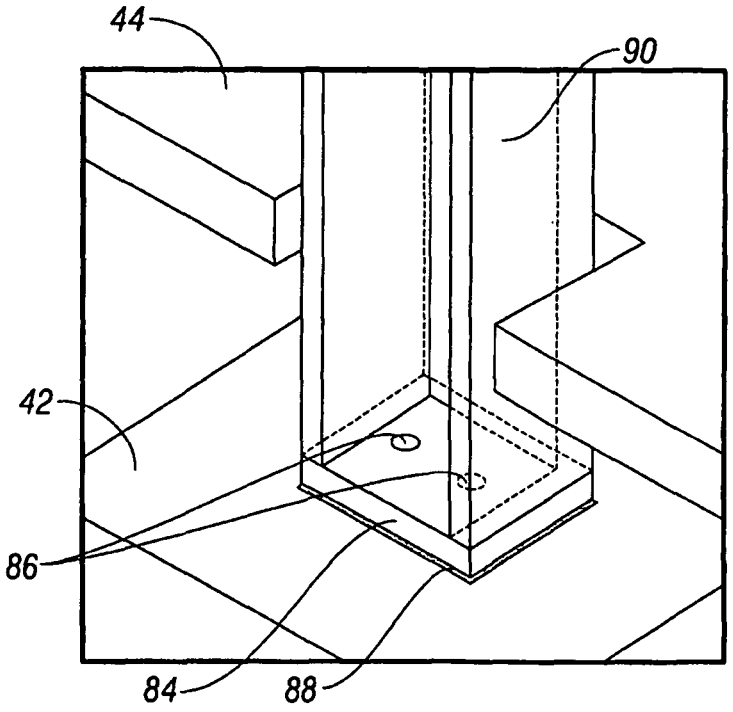
FIG. 5B is an isometric view of an upright mounted to an elevator in accordance with one embodiment of the invention.

FIG. 5B illustrates another configuration for attaching an upright to a portion of the elevator body 42. The bottom portion of an upright 90 is illustrated in the shape of a "C" bracket or a channel with three sides and a bottom 84. In this configuration, holes 86 are shown in the flat piece inside the channel of the "C" bracket for receiving bolts to connect the upright 90 to the elevator body 42. This configuration utilizes less space, providing an advantage in smaller or more compact elevators. Upright 90 may be welded at 88 to the elevator body 42, or bolted or both. FIGS. 5A and 5B provide two illustrative examples for securing the upright to the body of an elevator 40. One of ordinary skill in the art would appreciate a number of equivalent configurations for attaching an upright to a portion of the elevator body or to a timing ring, all of which are encompassed in the invention as defined by the claims attached hereto. The configurations described above attach the uprights to elevator body 42, but in certain embodiments the uprights could be fastened to the top flange of the timing ring 44 in the same manner described with respect to FIG. 5A or 5B.

Figure 6:
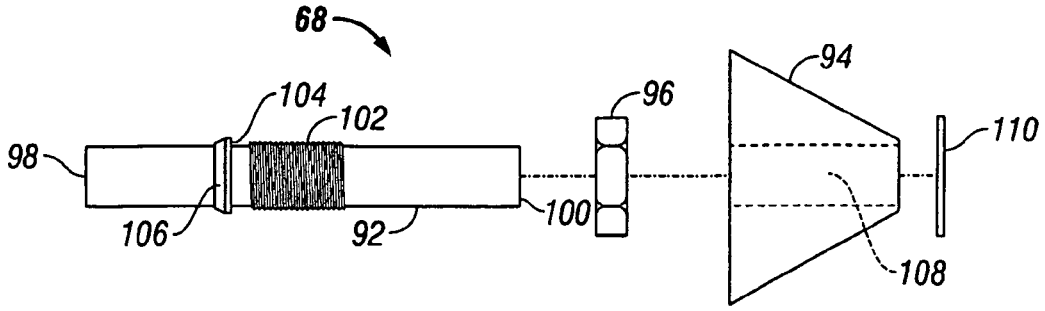
FIG. 6 is an exploded view of a portion of the stabilizing mechanism in accordance with one embodiment of the invention.

FIG. 6 illustrates one embodiment of the adjustable contacting member for the stabilizing mechanisms. The first stabilizing mechanism 68 comprises a rigid member 92, an adjustable member 94, and an adjustment nut 96. In one embodiment, the rigid member 92 is a rod. The rigid member 92 comprises a first end 98, a second end 100, and a threaded portion 102. A back washer 104 slides onto the first end 98 of the rigid member 92 and is welded at 106 into place at a location for creating a limit on the range through which the mechanism can be adjusted. The adjustment nut 96 then slides on the second end 100 of the rigid member 92 and mates to the threaded portion 102 of the rigid member 92. The back washer 104 prevents the adjustment nut 96 from coming off the first end 98 of the rigid member 92. An adjustable member 94 with a through hole 108 slides onto the second end 100 of the rigid member 92. The adjustability of this embodiment permits the adjustable contacting member(s) 94 to be urged into direct and firm contact with the bail in order to prevent or minimize tipping or pivoting of the elevator relative to the bail. The adjustable member 94 can be in the shape of a frustum cone, and the base of the cone is slid into contact with the adjustment nut 96. The conical shape is advantageous for securing the adjustable contact member 94 against bails of different sizes and configurations. However, any number of shapes could be employed for the adjustable member 94. In addition, the frustum cone could be slid onto the rigid member 92 in the reverse orientation so the small truncated portion contacts the adjustment nut 96 and the larger base of the cone contacts the bail. The adjustable member can be a hard rubber, plastic material, a resilient material, or any other material desired. Those skilled in the art will also appreciate that the adjustment nut 96 may be formed with the adjustable contacting member 94 so that rotating the adjustable contacting member adjusts it into abutting contact with the bail.

The conical shape of the adjustable contacting member 94, in combination with the through hole 108, allows the adjustable contacting member 94 to rotate about the rigid member 92 when the rigid member 92 is a rod. This rotation provides a particular advantage when the stabilizer 64 is attached to a part that moves up and down relative to the bails during operation. For example, if the timing ring 44 moves up and down relative to the elevator body. Because the bails do not move, the stabilizer 64 attached to the timing ring 44 actually slides up and down the bails during operation. Because the adjustable member 94 is rubber, it can rotate about the rigid member 92, significantly suppressing unwanted motion by maintaining the adjustable contacting member 94 in close contact with the bails with minimal damage and grinding to the parts. Finally, a washer 110 with an outer diameter greater than the through hole 108 of the adjustable member 94, is fixed to the second end 100 of the rigid member 92. Washer 110 maintains the adjustable member 94 and the adjustment nut 96 on the rigid member 92. Washer 110 can be welded to the second end 100 of the rigid member 92, or attached in any other manner known in the art.

Referring to FIGS. 4B and 6, the adjustable stabilizer operates as follows. A set of bails suspends the elevator 40. Adjustment nut 96 on the first stabilizing mechanism 68 is adjusted to urge the adjustable contacting member 94 of the first stabilizing mechanism 68 along the stabilizing member 92. It should be pointed out that the adjustable contacting member 94 can slide along the stabilizing member 92, and can also threadedly engage the stabilizing member so that rotating the adjustable contacting member will urge the adjustable contacting member into abutment with the bail. The adjustable contacting member 94 of the second stabilizing mechanism 70 is similarly adjusted into contact with the bail in the same manner. Once the adjustable contacting member 94 of the first stabilizing mechanism 68 and the adjustable contacting member 94 of the second stabilizing mechanism 70 have been urged into abutment with the first bail 54, the motion of the first bail 54 is suppressed with respect to the elevator 40. Referring back to FIG. 4B, the adjustable contacting member 94 of the third stabilizing mechanism 78 and the adjustable contacting member 94 of the fourth stabilizing mechanism 80 of the second stabilizer 66 are then urged against the second bail 56 in a similar fashion, stabilizing the pipe handling equipment with respect to the second bail 56.

FIG. 7A illustrates the first stabilizing mechanism 68 and the second stabilizing mechanism 70 mounted to the first upright 72 (the adjustable contacting members and adjustment nuts of the stabilizing mechanisms are not shown). The rigid member 92 of the first stabilizing mechanism 68 and second rigid member 112 of the second stabilizing mechanism 70 are each welded to a seat 76, which is attached to the top surface of the first upright 72. Seat 76 extends past the top surface of the first upright 72, providing a greater surface area for welding each of the rigid members of the stabilizing mechanisms. By affixing the rigid members along the edges of the seat, as shown in FIG. 7A, they can be offset by predetermined angles corresponding to the shape of the seat 76. In one embodiment, the seat's 76 trapezoidal shape directs each rigid member to point slightly outward. With reference to the first stabilizing mechanism 68, it can be seen that the rigid member 92 is welded to the seat 76 at the first end 98 of rigid member 92 along an edge of the seat 76. Threaded portion 102 extends away from the seat 76 for receiving the adjustment nut 96 and adjustable member 94. The second rigid member 112 of the second stabilizing, mechanism 70 is similarly welded along another edge of the seat 76.

Figure 7B:
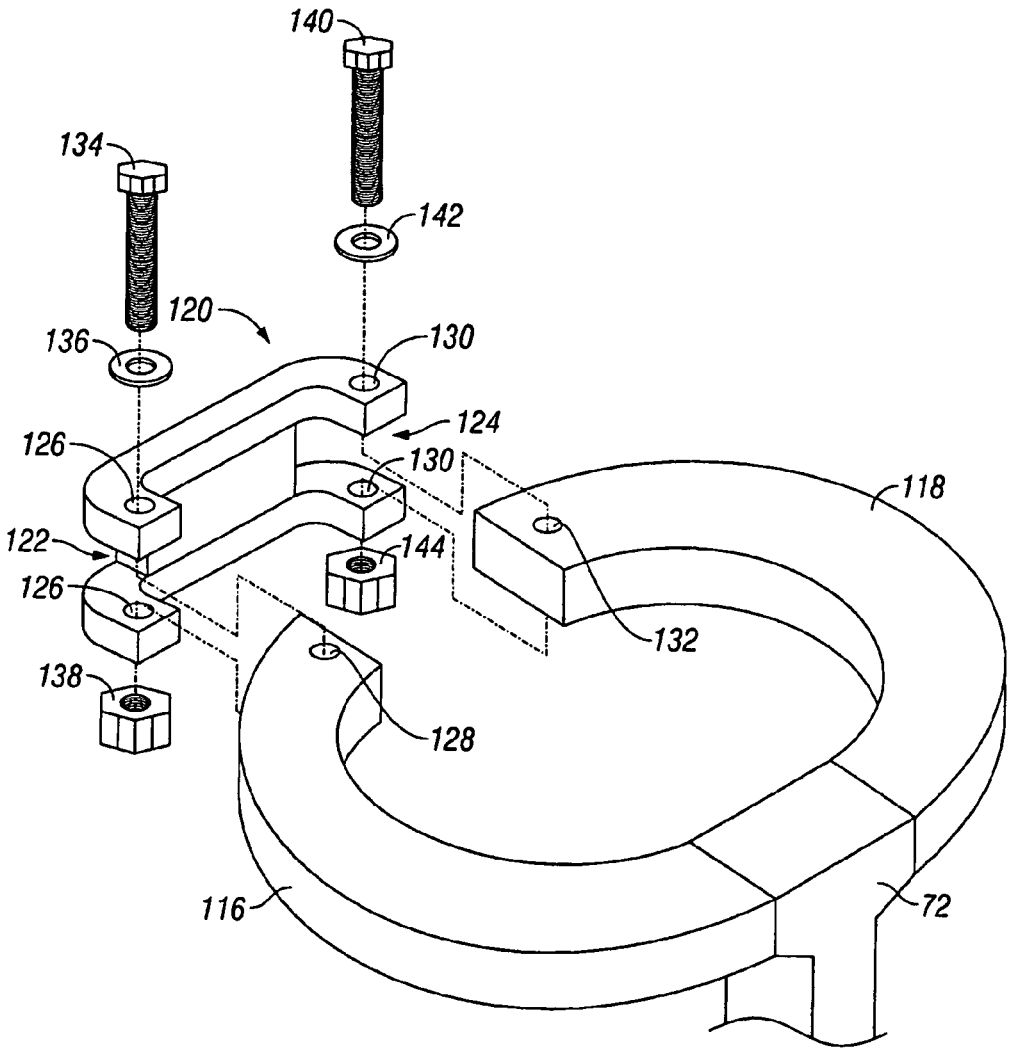
FIG. 7B is an isometric view of a stabilizer mounted to an upright in accordance with another embodiment of the invention.

FIG. 7B illustrates an embodiment of the invention which can be attached directly to a stable portion of an elevator, as illustrated in FIG. 5A or 5B and previously discussed. A first rigid member 116 and a second rigid member 118 attach to a first upright 72. The first rigid member 116 and the second rigid member 118 may be curved in shape or they may be straight. The embodiment depicted in FIG. 7B contains a latch 120 configured with a first slot 122 and a second slot 124. The first slot 122 receives the end of the first rigid member 116 and the second slot 124 receives the end of the second rigid member 118. Once a bail (not shown) has been disposed between the first rigid member 116 and the second rigid member 118, the latch 120 can be aligned to cover the lateral bail-insertion opening defined by the two stabilizing members 116, 118. Through holes 126 in the latch are matched to a pin hole 128 in the first rigid member 116. Likewise, second through holes 130 are matched to a pin hole 132 in the second rigid member 118. Once these holes are aligned, a fastener 134 such as a pin or bolt with a threaded end is placed through a washer 136 then through the through holes 126 of the latch 120 and the pin hole 128 of the first rigid member 116. A nut 138 is secured to the bolt 134 on the other side of the rigid member 116. A second bolt 140 is put through a second washer 142 then through the through holes 130 of the latch 120 and the pin hole 132 of the second rigid member 118. A nut 144 is secured to the bolt 140 on the other side of the second rigid member 118. While FIG. 7B illustrates curved rigid members and a latch assembly, one embodiment contemplates a bracket or set of straight rigid members which are connected to the elevator body or another stationary portion of the elevator.

Figure 8A:
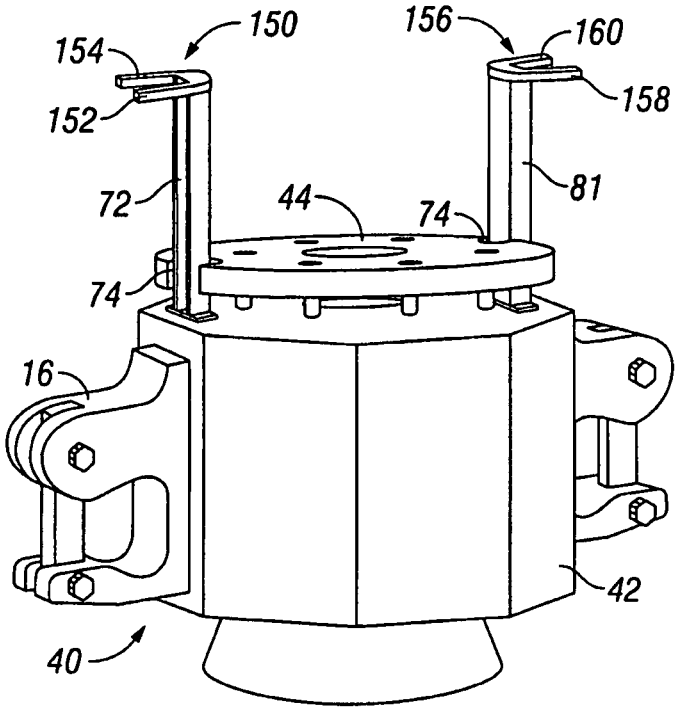
FIG. 8A is an isometric view of an elevator showing stabilizer mechanism brackets attached directly to the elevator body in accordance with one embodiment the invention.

FIG. 8A represents an embodiment of the invention where non-adjustable stabilizers suppress the elevator's movement with respect to the bails from which it is suspended. Adjustable stabilizers having the ability to rotate are preferable when the stabilizers are attached directly to the timing ring, but non-adjustable stabilizers, such as brackets 150, 156 can be used when the stabilizer is attached to the body of the elevator. Since the body 42 of the elevator 40 does not move up and down relative to the bails like the timing ring 44, the rotating features are not necessary.

FIG. 8A shows a first stabilizing bracket 150 attached to the first upright 72 which is connected to the body 42 of the elevator 40. The first bracket comprises a first elongated member 152 and a second elongated member 154. On the opposite side of the elevator, a second stabilizing bracket 156 is attached to a second upright 81. Like the first stabilizing bracket 150, the second stabilizing bracket 156 comprises a first elongated member 158 and a second elongated member 160. Stabilizing brackets 150 and 156 may be welded to the tops of their respective uprights. Cut outs 74 in the timing ring 44 provide clearance for uprights 72 and 81 to pass through the timing ring. The nonadjustable stabilizer could be one piece such as a bracket with two elongated members, or two independent elongated members attached to the upright. The elongated members may comprise a number of shapes and configurations so long as they are spaced to accommodate a bail between them.

Figure 8B:
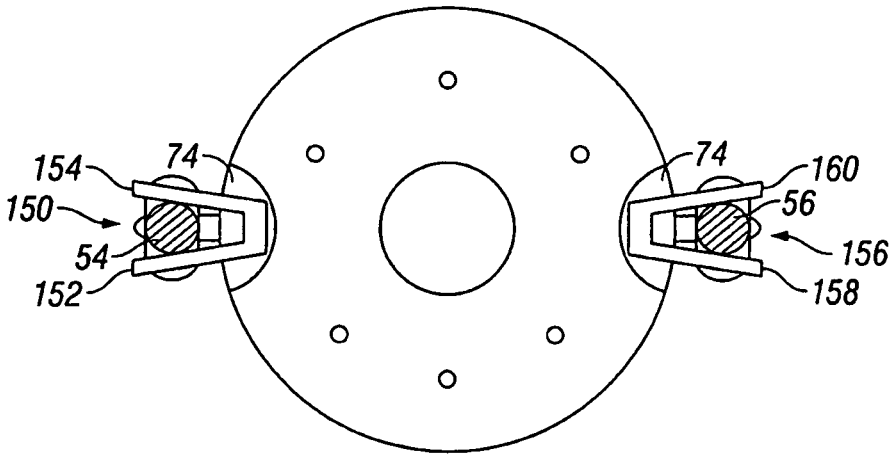
FIG. 8B is a top view of the embodiment of FIG. 8A, showing the bails in cross section.

FIG. 8B illustrates the first member 152 and the second member 154 of the first stabilizing bracket 150 in contact with the first bail 54 as well as the first member 158 and the second member 160 of the second stabilizing bracket 156 in contact with the second bail 56 to prevent any pivotal displacement of the elevator relative to the bails. This top view provides a clear illustration of the cut outs 74, which allow the timing ring 44 to move unimpeded by either stabilizing bracket.

While the embodiment illustrated in FIGS. 8A and 8B shows a bracket on each bail with a total of four elongated members, an alternative embodiment contemplates three, two or even a single elongated member. For example, in the case of an unbalanced elevator with a natural misalignment, the weight distribution of the elevator will bias the elevator body to rotate in the same direction relative to the bails. In order to prevent this misalignment, one elongated member can be placed on the "light side" of the elevator at one bail. In this way, an elongated member prevents the elevator body from rotating in one direction, and the forces tending to misalign the elevator body will act against rotation in the other direction.

Hybrids between the illustrated embodiments are also envisioned. For example, an elevator stabilizer or a set of elevator stabilizers could contain a combination of adjustable stabilizing mechanisms and non-adjustable elongated members. One example would be for the first and third stabilizing mechanisms to be adjustable, while the second and fourth stabilizing mechanisms are replaced with non-adjustable elongated members. The adjustable members and elongated members could be shaped to cooperate in securing a bail. In this way a bail could be secured from both sides by a single adjustment.

This invention relates to a stabilizer for suppressing unwanted movement in pipe handling equipment suspended from bails. Stabilizing an elevator as described herein is merely one illustrative embodiment where the invention provides an advantage, and the scope of the invention is not limited to such. The stabilizers could be mounted to any tool which is suspended by bails. It is apparent that changes and modifications may be made without departing from this invention in its broader aspects. Therefore, the claims which follow are intended to cover all changes and modifications that fall within the scope of the invention.

What is claimed is:

1. A system for stabilizing a pipe handling apparatus suspended from a first bail, the system comprising:

a first member connected to the pipe handling apparatus, the first member having a first longitudinal axis;

a first contacting member movably connected with the first member, wherein the first contacting member is movable linearly along the first longitudinal axis of the first member into a first position to abut the first bail and impede movement of the first bail;

a second member connected to the pipe handling apparatus, the second member having a second longitudinal axis; and a second contacting member movably connected with the second member, wherein the second contacting member is movable linearly along the second longitudinal axis of the second member into a second position to abut the first bail and impede movement of the first bail, wherein movement of the first contacting member, the second contacting member, or combinations thereof changes a distance between the first contacting member and the second contacting member.

2. The system of claim 1, wherein the first contacting member, the second contacting member, or combinations thereof comprise a conical shape.

3. The system of claim 1, wherein the first bail simultaneously contacts each of the first contacting member and the second contacting member.

4. The system of claim 1, wherein the first contacting member is rotatable about the first longitudinal axis of the first member, wherein movement of the first contacting member along the first longitudinal axis in a first direction positions the first contacting member closer to the bail, and wherein movement of the first contacting member along the first longitudinal axis in a second direction positions the first contacting member farther from the bail.

5. The system of claim 1, wherein the first member comprises exterior threads adapted for engaging interior threads of the first contacting member, a retaining member associated with the first contacting member, or combinations thereof.

6. The system of claim 1, further comprising an arm connecting the first member to the pipe handling apparatus, wherein the arm is positioned at an angle relative to the first member.

7. The system of claim 6, wherein the arm is generally perpendicular to the first member, to the pipe handling apparatus, or combinations thereof.

8. The system of claim 6, wherein the pipe handling apparatus comprises an elevator body having a timing ring in association therewith, and wherein the arm engages the elevator body and passes through a cut out portion of the timing ring.

9. The system of claim 1, further comprising:

a third member connected to the pipe handling apparatus, the third member having a third longitudinal axis; and a third contacting member movably connected with the third member, wherein the third contacting member is movable linearly along the third longitudinal axis of the third member into a third position to abut a second bail and impede movement of the second bail.

10. The system of claim 9, further comprising:

a fourth member connected to the pipe handling apparatus, the fourth member having a fourth longitudinal axis; and a fourth contacting member movably connected with the fourth member, wherein the fourth contacting member is movable linearly along the fourth longitudinal axis of the fourth member into a fourth position to abut the second bail and impede movement of the second bail.

11. The system of claim 10, wherein the movement of third contacting member, the fourth contacting member, or combinations thereof changes a distance between the third contacting member and the fourth contacting member.

12. The system of claim 10, wherein the third contacting member, the fourth contacting member, or combinations thereof comprise a conical shape.

13. The system of claim 1, wherein the bail comprises a longitudinal bail axis, and wherein the first contacting member is further movable in a direction substantially perpendicular to the longitudinal bail axis.

14. The system of claim 1, wherein the first contacting member and the second contacting member are movable closer to the first bail, and wherein at least a portion of a width of the first contacting member, the second contacting member, or combinations thereof is located between the first bail and the pipe handling apparatus to prevent movement of the first bail toward the pipe handling apparatus.

15. A method for stabilizing a pipe handling apparatus suspended from a first bail, the method comprising:

providing a first member connected to the pipe handling apparatus comprising a first longitudinal axis and having a first contacting member movably connected therewith;

moving the first contacting member linearly along the first longitudinal axis of the first member to a first position to contact the first bail, wherein the first contacting member impedes movement of the bail;

providing a second member connected to the pipe handling apparatus comprising a second longitudinal axis and having a second contacting member movably connected therewith; and moving the second contacting member linearly along the second longitudinal axis of the second member to a second position to contact the first bail, wherein the second contacting member impedes movement of the first bail, wherein a distance between the first contacting member and the second contacting member is adjustable, and wherein moving the first contacting member to the first position and moving the second contacting member to the second position adjusts the distance between the first contacting member and the second contacting member.

16. The method of claim 15, further comprising adjusting the first position of the first contacting member by rotating the first contacting member, a retaining member, or combination thereof about the first longitudinal axis of the first contacting member.

17. The method of claim 15, wherein moving the first contacting member to the first position comprises sliding the first contacting member linearly along the first longitudinal axis of the first member, rotating the first contacting member about the first longitudinal axis of the first member rotating a retaining member about the first longitudinal axis of the first contacting member, or combinations thereof.

18. The method of claim 15, further comprising securing interior threads of a retaining member to exterior threads positioned on the first member for retaining the first contacting member in the first position.

19. The method of claim 15, wherein moving the first contacting member to the first position and moving the second contacting member to the second position enables the first bail to simultaneously contact the first contacting member and the second contacting member and be retained between the first contacting member and the second contacting member.

20. The method of claim 15, further comprising:

providing a third member connected to the pipe handling apparatus comprising a third longitudinal axis and having a third contacting member movably connected therewith; and moving the third contacting member linearly along the third longitudinal axis of the third member to a third position to contact a second bail, wherein the third contacting member impedes movement of the second bail.

21. The method of claim 20, further comprising:

providing a fourth member connected to the pipe handling apparatus comprising a forth longitudinal axis and having a fourth contacting member movably connected therewith; and moving the fourth contacting member linearly along the fourth longitudinal axis of the fourth member to a fourth position to contact the bail, wherein the fourth contacting member impedes movement of the second bail.

* * * * *